US006375825B1

(12) United States Patent
Mauldin et al.

(10) Patent No.: US 6,375,825 B1
(45) Date of Patent: Apr. 23, 2002

(54) PROCESS FOR THE PRODUCTION OF ALKALINE EARTH HYDROXIDE

(75) Inventors: Lloyd Ballard Mauldin; Charles Adams, Jr.; Donald R. Randolph, all of Cartersville, GA (US); Duane J. Mazur, Amherst, NY (US); J. David Genders, Marilla, NY (US); Dennis M. Chai, East Amherst, NY (US)

(73) Assignee: Chemical Products Corporation, Cartersville, GA (US)

( * ) Notice: Subject to any disclaimer, the term of this patent is extended or adjusted under 35 U.S.C. 154(b) by 0 days.

(21) Appl. No.: 09/428,738

(22) Filed: Oct. 28, 1999

(51) Int. Cl.[7] ..... C25B 1/20
(52) U.S. Cl. ..... 205/508
(58) Field of Search ..... 295/508

(56) References Cited

U.S. PATENT DOCUMENTS

| | | | | |
|---|---|---|---|---|
| 973,171 A | * | 10/1910 | Clemm | 205/508 |
| 3,366,449 A | | 1/1968 | Marshall et al. | |
| 3,909,378 A | | 9/1975 | Walmaley | |
| 4,025,405 A | | 5/1977 | Dotson et al. | |
| 4,113,585 A | * | 9/1978 | Resnick et al. | 205/508 |
| 4,192,725 A | | 3/1980 | Dotson et al. | |
| 4,196,068 A | * | 4/1980 | Scoville | 205/531 |
| 4,202,743 A | | 5/1980 | Oda et al. | |
| 4,212,713 A | | 7/1980 | Suhara et al. | |
| 4,219,394 A | | 8/1980 | Babinsky et al. | |
| 5,039,382 A | | 8/1991 | Suzuki et al. | |
| 5,149,403 A | | 9/1992 | Shimohira et al. | |
| 5,264,090 A | | 11/1993 | Hiyoshi et al. | |
| 5,716,504 A | | 2/1998 | Saito et al. | |

FOREIGN PATENT DOCUMENTS

| | | |
|---|---|---|
| JP | 54125199 | 9/1979 |
| WO | WO/9934895 | 7/1999 |

OTHER PUBLICATIONS

John Payne, Nafion—Perfluorosulfonate Ionomer, Mauritz—Nafion Research, Nov. 8, 1998, pp. 1–4.

DuPont Product Information Bulletin 97–01 (Rev. Jan. 4, 1999) entitled "General Information on Nafion® Membrane for Electrolysis".

* cited by examiner

*Primary Examiner*—Arun S. Phasge
(74) *Attorney, Agent, or Firm*—Todd Deveau; Troutman Sanders LLP

(57) ABSTRACT

A process for the continuous production of alkaline earth metal hydroxide by continuously providing an aqueous alkaline earth metal halide solution to the anode compartment and an aqueous alkaline earth metal hydroxide solution or water to the cathode compartment of an electrolytic cell in which an anode and a cathode are maintained in separate anode and cathode compartments, respectively, by a stable, hydrated, cation selective, hydraulically impermeable, electrically conductive membrane interposed between said anode and said cathode; electrolyzing the alkaline earth metal halide solution; and continuously removing alkaline earth metal hydroxide solution and hydrogen from the cathode compartment and halogen from the anode compartment. The membrane is a film of a fluorinated polymer with pendant side chains containing sulfonyl groups present as ion exchange sites and attached to carbon atoms which have at least one fluorine atom attached thereto. In another embodiment the membrane is a laminate of two such polymers differing in equivalent weight.

36 Claims, 2 Drawing Sheets

PROCESS FOR THE PRODUCTION OF ALKALINE EARTH HYDROXIDE

BACKGROUND OF THE INVENTION

1. Field of the Invention

This invention relates to a process for the production of alkaline earth metal hydroxides, particularly for the electrochemical production of barium hydroxide utilizing ion exchange membrane technology.

2. Background of the Invention

Barium hydroxide is typically produced commercially using one of a number of chemical processes. One example is that disclosed in German Patent No. 519,891 (Oct. 22, 1929) whereby barium sulfide in water solution is contacted with air, oxygen therein reacting with barium sulfide to form a mixed barium polysulfide/barium hydroxide solution from which barium hydroxide is crystallized. Other methods are known, for example that disclosed in U.S. Pat. No. 3,366,449 to Chemical Products Corporation in which an aqueous solution of barium sulfide is passed through a column of internally bifunctional ion exchange resin followed by elutriation with water to recover a dilute solution of barium hydroxide. Another example is disclosed in U.S. Pat. No. 1,136,133 in which barium hydroxide is crystallized from a solution of barium sulfide or chloride enriched in hydroxyl ions by the addition of either sodium hydroxide or ammonium hydroxide.

These methods, as well as others that could be cited, fail to be commercially attractive because of low chemical conversion of the raw materials to the desired product, excessively high impurity levels, environmental constraints, or combinations thereof.

The possibility of making barium hydroxide via electrochemical means was investigated as early as 1903 (*Compt.Rend.* 1903, v135, p1195). Following that, several patents teach the electrolytic treatment of barium chloride to make barium hydroxide, e.g. A. Clemm U.S. Pat. No. 973,171 (1910); German Patent 227,096 (1907); British Patent 5,471 (1910), all utilizing a diaphragm divided electrochemical cell. Later publications describe the use of mercury cell to produce barium hydroxide (P. P. Fedotiev, *Z. Anorg. Chem.,* 1914, 86, 325; L. A. Isarov, *Tr. Nauch.-Issled. Inst. Osn. Khim,* 1969, 155. More recent Russian work based on a diaphragm cell process was disclosed in USSR Patent 361,143 (1972) and published in *Pereab. Margants Polimeta, Rud Gruz.,* 1974. Another example describing the electrolysis in a diaphragm cell of barium sulfide to provide barium hydroxide is reported in Brazil Patent 85 05275 (1987).

All of these electrochemical methods disclosed to date have involved either mercury cell technology which is environmentally unacceptable for new processes today or diaphragm cell technology which results in excessive impurities, e.g. chloride, in the product. These processes are technically similar to processes which today are widely used in the chloralkali industries for the production of sodium hydroxide, chlorine and hydrogen by the electrolysis of sodium chloride brine. Another process widely used in the chloralkali industry to overcome some of the above objections to the mercury cell and diaphragm cell processes is known as the ion exchange membrane process, or membrane process for short.

The membrane process is similar to the diaphragm cell process in that a 2-compartment cell is created, thus separating the cathode from the anode. In the membrane process the separator is a non-porous sheet of material having the ability to transfer ions, preferably cations, from the anode compartment into the cathode compartment under the influence of an imposed electrical field. Electrical neutrality is maintained by means of the electrochemical processes that operate at the anode and cathode. The membrane process is used world wide today in the production of millions of tons per year of sodium hydroxide, chlorine and co-product hydrogen. Important to the success of such processes is the selection of the type of membrane used in the cell. Membranes which have been found to be particularly successful are characterized as having a bilayer structure, in which the major structure is a perfluorinated sulfonated polymer. The surface in contact with the catholyte is a perfluorinated carboxylate polymer. However, the use of membranes in the chloralkali industry requires that the feed brine be exceptionally pure with respect to alkaline earth cations, e.g. magnesium, calcium, strontium, and barium The presence of alkaline earth cations in the brine feed to the cell leads to degradation of membrane performance and can cause the membrane to rupture. Thus, it is widely believed in the art that the detrimental effect of alkaline earth cations on the membrane would preclude the direct electrolysis of alkaline earth brine to the corresponding hydroxide.

SUMMARY OF THE INVENTION

The present invention provides a process and apparatus for the production of alkaline earth metal hydroxide of exceptionally high purity by the electrolysis of alkaline earth metal halide brine in a membrane-divided electrochemical cell, the membrane being typified as a perfluorinated, sulfonated cation exchange membrane, thereby overcoming the objectionable features of all other proposed chemical and electrochemical processes.

The novel process disclosed herein is an electrochemical process in which alkaline earth metal halide brine (the anolyte) is circulated through the anode half-cell of an electrolysis cell. The cathode half-cell contains a circulating stream of alkaline earth metal hydroxide (the catholyte). The two half-cells are separated by a perfluorosulfonate polymer "ion exchange" membrane which is chemically capable of allowing the alkaline earth metal ions to transfer from the anolyte to the catholyte under the influence of the imposed electrical potential difference between the cathode and anode, thereby completing the electrical circuit by the transfer of ions across the membrane.

In the preferred embodiment of the process, the alkaline earth metal hydroxide is barium hydroxide, and the preferred alkaline earth metal halide is barium chloride. Surprisingly, it was found that barium ions do not significantly degrade the performance of the membrane in this process. The quantity of barium ions so transported is equivalent chemically to the quantity of hydroxide ions produced by the cathode-side electrolysis of water. The main reactions occurring in the process are:

| | |
|---|---|
| Anode: | $BaCl_2 \rightarrow Cl_2 + Ba^{2+} + 2e^-$ |
| Cathode: | $2H_2O + 2e^- \rightarrow H_2 + 2OH^-$ |
| Overall: | $BaCl_2 + 2H_2O \rightarrow Cl_2 + H_2 + Ba(OH)_2$ |

There are also several reactions that may occur at the anode, resulting in inefficiencies in the run; the primary ones are:

(1) $6HOCl + 3H_2O \rightarrow 2ClO_3^- + 3/2O_2 + 4Cl^- + 12H^+ + 6e^-$
(2) $2H_2O \rightarrow O_2 + 4H^+ + 4e^-$
(3) $HOCl + H_2O \rightarrow 3H^+ + Cl^- + O_2 + 2e^-$ Thus, the catholyte solution concentration of barium hydroxide increases with elapsed time of electrolysis unless the catholyte is diluted or barium hydroxide is removed from the catholyte solution by crystallization or by other means.

DETAILED DESCRIPTION OF THE PREFERRED EMBODIMENT

Figure 1:
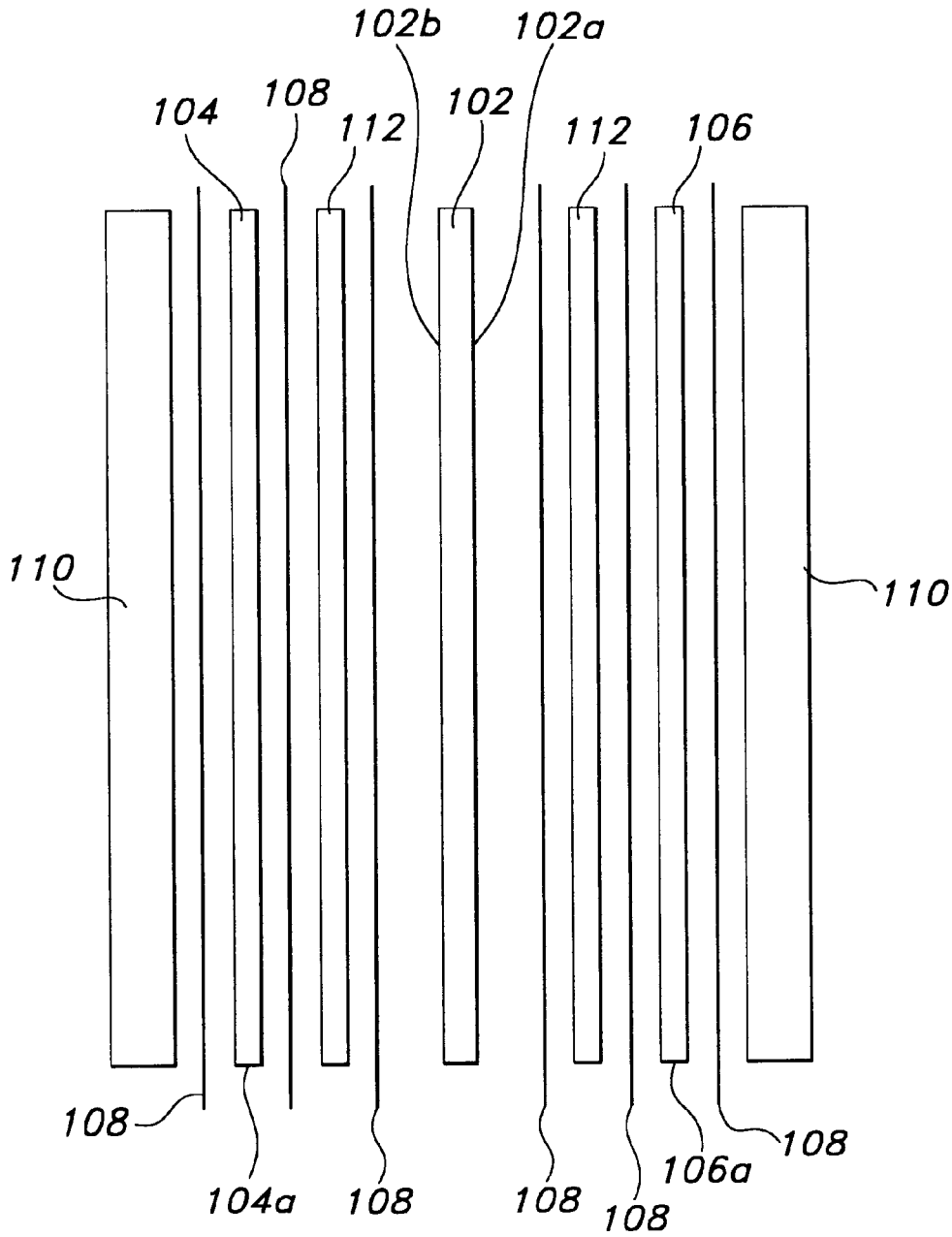
FIG. 1 illustrates an exemplary embodiment of a system for producing alkaline earth metal hydroxides in accordance with the present invention.
Figure 2:
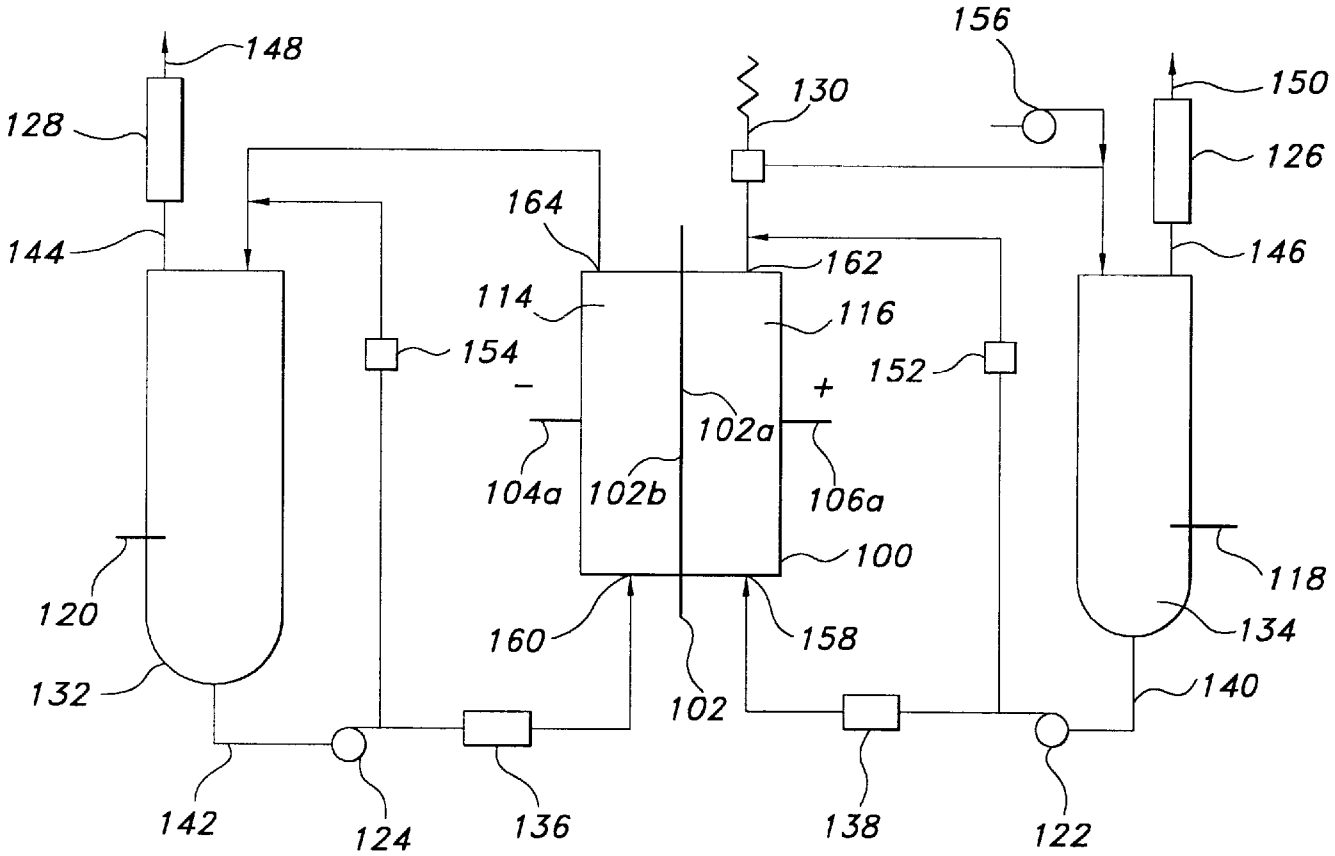
FIG. 2 illustrates an electrolytic cell for use in accordance with the exemplary embodiment of FIG. 1, in accordance with the present invention.

Referring to FIGS. 1 and 2, the electrolytic cell 100, is divided into an anode compartment 116, and a cathode compartment 114, by membrane 102. The cell 100 is also provided with electrolyte inlet 158, spent electrolyte outlet 162, alkaline earth metal hydroxide product outlet 164 and chlorine and hydrogen gas outlets 146 and 144, respectively. An anode 106 and anode lead 106*a,* are positioned in the anode compartment 116 and cathode compartment 114 has disposed therein a cathode 104 and cathode lead 104*a*. The preferred electrochemical cell is a divided electrochemical flow cell equipped with PTFE spacers 112 and gaskets 108 and configured as diagramatically represented in FIG. 1. PTFE turbulence promoters 112 are placed on both sides of the membrane 102 for support and to prevent it from touching either electrode 104, 106. A particularly suitable cell is an ICI FM01 electrochemical flow cell. Any suitable cell can be configured in a monopolar or bipolar manner.

The anode 106 can be of any suitable configuration such as a sheet or rod, flat or corrugated, rectangular or unsymmetrical. A foraminous sheet is preferred. The anode 106 is comprised of an electrically conductive substrate with a surface coating thereon of a defect solid solution of at least one precious metal oxide and at least one metal oxide. In these solid solutions an interstitial atom of metal oriented in the characteristic rutile metal oxide crystal lattice host structure is replaced with an atom of precious metal. This distinguishes the coating from mere physical mixtures of the oxides, since pure metal oxides are in fact insulators. Such substitutional solid solutions are electrically conductive, catalytic and electrocatalytic.

Within the above-mentioned solid solution host structures the suitable metals include: titanium, tantalum, niobium and zirconium while the suitable implanted precious metals encompass platinum, ruthenium, palladium, iridium, rhodium and osmium The electrically conductive substrate can be constructed of the metals that are defined above as included in the solid solutions. The preferred anode 106 is chlorine-evolving ruthenium oxide electrocatalyst coated onto a titanium substrate available commercially from ICI as METCOTE ES-5, flat plate or from ELTECH as a DSA-Chlorine anode.

The cathode 104 can be any suitable conductive material or metal capable of withstanding the corrosive catholyte cell conditions and which is characterized by low hydrogen overvoltage. A useful metal is generally selected from the group of foraminous metals consisting of stainless steel, nickel, cobalt, titanium, steel, lead and platinum. The cathode 104 can be in the form of a solid sheet or other solid metal configuration or foraminous, such as expanded metal mesh or screen of high surface area. The preferred cathode is a flat nickel plate.

The membrane 102 can be a film formed from a stable hydrated ion-exchange resin which is a fluorinated copolymer having pendant sulfonic acid groups. The preferred membranes of the present invention are perfluorosulfonate polymer membranes such as those sold under the trademark NAFION by E.I. du Pont de Nemours. The structure of such membranes are described in U.S. Pat. Nos. 3,282,875; 3,041,317; 3,718,627; 3,560,568; 3,909,378; 3,624,053; 3,969,285; and British Pat. No. 1,184,321; all incorporated herein by reference. Generically speaking, such polymers are fluorinated polymers with pendant side chains containing sulfonyl groups. The sulfonyl groups are present as ion exchange sites and are attached to carbon atoms which have at least one fluorine atom attached thereto.

The preferred membranes are DUPONT NAFION 400 series perfluorinated, single equivalent weight sulfonate polymer cation exchange membranes and DUPONT NAFION 350 cation exchange membrane, which is a composite of the perfluorinated sulfonate polymer films differing in equivalent weight, both available from E.I. du Pont de Nemours. DUPONT NAFION 400 series membranes are single-layer perfluorosulfonic acid cation exchange membranes with a strong polytetrafluoroethylene fiber reinforcement. DU PONT NAFION 350 is a laminate of two layers of perfluorinated sulfonic acid polymers with an equivalent weight of 1100 on the anode side 102*a* and an equivalent weight of 1500 on the cathode side 102*b,* and is reinforced with a durable fiber. Equivalent weight is the weight of the polymer in grams containing one equivalent of potential ion exchange capacity. The difference in equivalent weight can vary, but the higher equivalent weight polymer is on the cathode side 102*b* to improve resistance to hydroxide ion back migration to the anolyte side 102*a*. The membranes are preferably pretreated by soaking in a barium chloride or barium hydroxide solution for several hours at room temperature.

The invention will now be described with reference to the production of chlorine and a barium hydroxide of high purity made by the electrolysis of barium chloride solution, but it is to be understood that the invention is not restricted to production of barium hydroxide but can also be utilized for making other alkaline earth metal hydroxides by the electrolysis of other aqueous alkaline earth metal halide solutions such as strontium chloride. Referring to FIG. 2, the process of the invention can be carried out on a continuous basis by continuously introducing barium chloride solution into the anolyte reservoir 134 and initially introducing a starting catholyte into the catholyte reservoir 132. The starting anolyte feed for each electrolysis is prepared by dissolving barium chloride dihydrate in deionized water. This solution is preferably heated to completely dissolve all of the barium chloride and to minimize the possibility of recrystallization when the solution is first introduced into the anolyte reservoir 134. The starting catholyte solution is prepared by dissolving barium hydroxide octahydrate in deionized water. This solution is preferably made fresh before each run in a closed container to minimize the formation of barium carbonate.

The barium chloride solution is decomposed by imposing a potential difference between the anode 106 and the cathode 104 of said cell 100, whereby the water and barium ions are transported through a permselective cation exchange membrane film 102 of the fluorinated copolymer having the previously described structural formula.

The control of the temperature is important in the process to avoid crystallization of the anolyte and/or catholyle within the process equipment and to avoid heat damage to the membrane, cell spacers, and gaskets. The temperature is maintained at about 70° C. to about 90° C., preferably about 70° C. to about 85° C., with about 80° C. being the most preferred.

The pH of solution in the anolyte loop 140 plays a significant role in the overall operation of the process. At higher pH's, the formation of hypochlorite species by the reaction of chlorine with hydroxyl ions can damage the anode 106 and lead to the formation of other unwanted byproducts at the anode 106. If the pH is too low, then the ion transport across the membrane 102 is by $H^+$ instead of $Ba^{2+}$. Moreover, anolyte solutions with too low pH's are known to accelerate chemical and electrochemical corrosion in the crevices of the coated anode surface 106. The pH is maintained at from about 2.0 to about 4.0, preferably from about 3.4 to about 3.7. The anolyte pH is continuously monitored by a pH probe 130 and automatically adjusted as necessary by introduction of an acid, preferably hydrochloric acid, by the acid pump 156.

The barium ions pass through said membrane 102 into the cathode compartment 114 from the anode compartment 116 along with water. A portion of the water molecules is reduced at the cathode 104 to form hydrogen and hydroxyl ions to produce barium hydroxide in the cathode compartment 114.

The chloride ions in the barium chloride solution are attracted to the anode 106, oxidized and eventually released from the anode compartment 116 as chlorine gas through the chlorine gas outlet 146 into a condenser 126 to remove water vapor from the chlorine gas. The chlorine gas can be vented 150 under slight vacuum into a scrubber (not shown) containing water to make hypochlorous acid or containing a solution of sodium hydroxide which reacts quantitatively with chlorine to form bleach (sodium hypochlorite). Alternatively, the chlorine can be used for its oxidizing value in a chemical process or compressed and stored in cylinders for later use or sale. Hydrogen gas, which is formed in the cathode compartment 114 at the same time as the barium hydroxide, can be removed from the catholyte reservoir 132 through a hydrogen gas outlet 144 to a condenser 128 to remove water vapor from the gas. The hydrogen gas can be vented via 148 to the atmosphere, burned for its fuel value, reacted with the chlorine gas from 130 to produce hydrogen chloride for conversion to hydrochloric acid, or collected by known means.

Components external to the cell comprise a brine (anolyte) makeup loop 140 and a product (catholyte) loop 142.

The anolyte loop 140 comprises an anolyte reservoir 134; an anolyte circulation pump 122; an anolyte flow sensor 138; the anode compartment 116 of the cell 100; an anode potential monitor 152; a pH Probe 130, and an HCl pump 156.

The anolyte reservoir 134 is preferably an insulated metal tank selected for resistance to corrosion and low heat transfer. In operation, a barium chloride solution is continuously introduced into the reservoir 134 and pumped by anolyte circulation pump 122 through the anolyte loop 140. The flow rate depends on the loop size and is monitored and controlled by a flow sensor 138 coupled with a flow controller (not shown).

The anolyte enters the anode compartment 116 of the cell 100 through the anolyte inlet 158 and exits through the anolyte outlet 162. The pH probe 130 and controlled by introduction of an acid, preferably hydrochloric acid, by acid pump 156 upon demand by the pH controller (not shown) coupled with the pH probe 130. The anode potential is monitored continually by the anode potential monitor 152, preferably an Ag/AgCl reference electrode, mounted in a separate circulation loop.

The catholyte loop 142 comprises a catholyte reservoir 132; a catholyte circulation pump 124; a catholyte flow sensor 136; the cathode compartment 114 of the cell 100; and a cathode potential monitor 154.

The catholyte reservoir is preferably a metal tank selected for resistance to corrosion and low heat transfer. In operation, the catholyte is pumped by the catholyte circulation pump 124 through the catholyte loop 142. The flow rate depends on loop size and is monitored and controlled by a flow sensor 136 coupled with a flow controller (not shown).

The catholyte enters the compartment 114 of the cell 100 through the catholyte inlet 160 and exits through the catholyte outlet 164. The cathode potential is monitored continuously by the cathode potential monitor 154, preferably an Ag/AgCl reference electrode, mounted in a separate circulation loop.

EXAMPLES

The apparatus described below was used to collect the data in Examples 1–9.

The cell was a divided ICI FM01 electrochemical flow cell equipped with PTFE; spacers and gaskets. The membranes were pretreated by soaking in a 1.0 Molar barium chloride solution for several hours at room temperature. Power to the cell was provided by a SORENSON DCS 20–50 power supply.

The anolyte loop 140 consisted of a 1 liter insulated glass reservoir and a March MDK-MT3 circulating pump with a Kynar head. The flow rate was monitored/controlled using a Signet Scientific Co. #3-2057-100-6V Kynar magnetic paddle wheel flow sensor coupled with an Omega #DPF75 flow controller. The temperature was controlled using an Omega #CN310 temperature controller coupled with a type "J" thermocouple mounted in a glass thermwell in the solution reservoir. Heat was provided using a SAMOK® 468 watt heating tape wrapped around the reservoir. The vacuum was provided by an air Cadet #7530-40 vacuum pump. The pH of the brine exiting the cell was controlled at 3.4–3.7 using an Omega #PHCN-36 pH/ORP controller coupled with a Cole Parmer #H05991-32 pH electrode mounted in the cell anolyte exit line. Acid was fed to the anolyte as 37% hydrochloric acid, (ACS reagent grade, Aldrich Chemical Co.) using a Masterflex peristaltic pump operated on demand from the pH controller. The anode potential was monitored continually using a Ag/AgCl reference electrode mounted in a separate circulation loop and connected to a luggin probe placed at the electrode.

The catholyte loop consisted of an insulated 2 liter glass reservoir and a magnetically coupled gear pump (#H07144-91 motor, #H0700140 SS head, Cole Parmer Instrument Co.) for circulation. The flow rate and temperature were monitored/controlled using similar equipment as that used for the anolyte loop: flow sensor, temperature controller and thermocouple. The cathode potential was monitored continually in the same way as in the anolyte loop, with a Ag/AgCl reference electrode mounted in a separate circulation loop and connected to a luggin probe placed at the electrode.

Selected data (cell voltage, electrode potentials, anolyte solution pH solution temperatures) were monitored and recorded continually using the Ducksoup™ Version 1.23 data acquisition software coupled with a Keithly Metrabyte DAS1401 data acquisition board. All voltage signals coming into the board were first passed through a National Instruments #SCXI 1120 signal isolation amplifier connected to a #SCXI 1000 chassis (for power) through a #SCXI 1320 terminal block. All major electrical components of the system were connected to a Sola #500 uninteruptible power supply to ensure continued operation.

The starting anolyte feed for each electrolysis was prepared by dissolving 488.66 g of barium chloride dihydrate manufactured and supplied by Chemical Products Corporation, up to 1.0 liter with deionized water. This solution was heated to 65 degrees C.

The starting catholyte solution for the first run was prepared by dissolving 94.6 g barium hydroxide octahydrate which was prepared in the development laboratory of Chemical Products Corporation, in deionized water to a final volume of 1.50 liters in a closed flask.

To track the progress of an experiment, samples of catholyte were taken frequently during the run and analyzed for hydroxide concentration using a simple acid/base titration. The final concentration along with the measured volume of catholyte solution at the end of the run was used to calculate the overall current efficiency for that run. A known volume was also weighed to determine concentrations on a weight percent basis.

End-of-run samples were analyzed for chloride using a DIONEX DX-500 Ion Chromatograph equipped with a CD-20 conductivity detector, GP-40 gradient pump, and controlled using the Peaknet™ software system Samples were also analyzed for Strontium by atomic absorption using PERKIN ELMER #3110 AA spectrophotometer.

The amount of hypochlorite produced as a result of the absorption of the off-gas chlorine in potassium hydroxide was determined by standard iodometric titration. The chlorine current efficiency was then calculated for the run.

A typical electrolysis run was conducted as follows. Starting anolyte and catholyte solutions were prepared and loaded into their respective reservoirs. The anolyte and catholyte circulating pumps were started and the temperature allowed to reach the set point. During this time, the pH controller was also turned on and the pH adjusted as required. The electrolytic current was started and a given current maintained for a preset period of time. Periodic samples of catholyte were taken during the run and analyzed for hydroxide to follow the progress of the run.

At the completion of the electrolysis, the current was stopped, catholyte compartment drained and the volume, weight, strontium and hydroxide contents of the catholyte measured. The compartment was rinsed with deionized water and both the rinse and the catholyte were analyzed to determine the hydroxide strength. The anolyte compartment was drained, volume measured and analyzed for chlorine content. The scrubber solution (hypochlorite) volume was measured and analyzed for chloride value.

A number of runs were made in which the effect of changing variables such as temperature, membrane type, strontium concentration in the anolyte, and current density were evaluated by the procedures detailed above. The following examples and the resulting data in Table I illustrate the successful application of the principles of this novel process to the production of barium hydroxide.

Example 1

NAFION 424 membrane was installed in the cell prior to the run. A relatively low current density of 200 mA/cm$^2$ was set for this run. After the preset quantity of current had been passed, the electrolysis was stopped, samples were collected and analyzed. The results of this example indicated that the chlorine and hydroxide efficiencies were quite low, as shown in Table 1.

Example 2

The conditions of Example 1 were followed except current density was set at 250 mA/cm$^2$. There was a significant increase in chlorine current efficiency but no significant change in hydroxide current efficiency. Cell voltage increased, to 4.66 V.

Example 3

This example was a repeat of Example 2, and the results are very similar to that Example.

Example 4

In this example the current density was increased to 300 mA/cm$^2$ with all other conditions remaining constant compared to Example 1. Again, the chlorine current efficiency increased significantly, but the hydroxide current efficiency remained low, indicating excessive back migration of hydroxide ions from the catholyte side to the anolyte side of the cell. Cell voltage increased again, to 5.0 V.

Example 5

The conditions of this example duplicated Example 4 except for the membrane. NAFION 350 membrane was installed in the cell in the expectation that this membrane would be more resistant to the back migration of hydroxide ions, thus improving the hydroxide efficiency significantly. The example data show that chlorine efficiency remained high and hydroxide current efficiency increased markedly over previous runs using NAFION 424.

Example 6

The conditions of this example duplicated that of Example 5 except the temperature was increased to 85 Degrees C. This example was terminated prematurely because of pumping difficulties. However, the chlorine efficiency was markedly improved over previous examples and the hydroxide efficiency was also improved. The cell voltage dropped to 4.60 V.

Example 7

The anolyte feed in this example contained 5000 ppm strontium (as strontium chloride). Electrolysis conditions were the same as Example 6 except the temperature was dropped to 80 degrees C. The chlorine current efficiency remained high, but there was a significant drop in the hydroxide current efficiency. It is believed that the strontium ions penetrated into the membrane and precipitated therein as strontium hydroxide, disrupting the membrane structure and reducing the membrane's ability to reject hydroxide ion back migration. Attempts to restore the membrane functionality by acid washing with and without cell power were not successful, and this membrane was removed from service.

Example 8

Following the installation of fresh, conditioned NAFION 350 membrane, the conditions of this example duplicated Example 6 except the temperature was reduced to 80 Degrees C. High chlorine and hydroxide efficiencies were achieved.

Example 9

This final example duplicated Example 8 except it was made at a current density of 400 mA/cm$^2$. Excellent chlorine and hydroxide efficiencies were achieved at a cell voltage of 5.52 V.

TABLE I

| Example No. | Current Density Ma/cm$^2$ | Final Catholyte Concen. %Ba(OH)$_2$.8 H$_2$O W/W | Charge Passed (F) | Temp ° C. | Membrane NAFION No. | Current Efficiency Chloride (Anode) % | Current Efficiency hydroxide (Cathode) % | Final Cell Voltage |
|---|---|---|---|---|---|---|---|---|
| 1 | 200 | 18.1 | 1.175 | 70 | 424 | 70 | 65 | 4.27 |
| 2 | 250 | 17.7 | 1.194 | 70 | 424 | 79 | 64 | 4.66 |
| 3 | 250 | 16.8 | 1.194 | 70 | 424 | 78 | 60 | 4.66 |
| 4 | 300 | 16.7 | 1.193 | 70 | 424 | 89 | 60 | 5 |
| 5 | 300 | 20.3 | 1.193 | 70 | 350 | 80 | 88 | 5.01 |
| 6 | 300 | 19.2 | 1.055 | 85 | 350 | 93 | >82 | 4.6 |
| 7 | 300 | 17.8 | 1.193 | 80 | 350 | 82 | 74 | 4.71 |
| 8 | 300 | 20 | 1.193 | 80 | 350 | 91 | 88 | 4.75 |
| 9 | 400 | 19.8 | 1.194 | 80 | 350 | 95 | 84 | 5.52 |

It is obvious that those skilled in the art may make modifications to the invention without departing from the spirit of the invention or the scope of the subjoined claims and their equivalents.

What is claimed is:

1. A process for the continuous production of alkaline earth metal hydroxide comprising:

a. continuously providing an aqueous alkaline earth metal halide solution to the anode compartment of an electrolytic cell in which an anode and a cathode are maintained in separate anode and cathode compartments, respectively, by a hydrated, cation selective, hydraulically impermeable, ionically conductive membrane interposed between said anode and said cathode;

b. electrolyzing the alkaline earth metal halide solution;

c. continuously removing alkaline earth metal hydroxide solution and hydrogen from the cathode compartment and halogen from the anode compartment;

said membrane comprising a cation exchange membrane wherein sulfonyl groups serve as the predominant ion exchange site.

2. A process as claimed in claim 1, wherein said membrane comprises a film of a fluorinated polymer with pendant side chains containing sulfonyl groups, said sulfonyl groups present as ion exchange sites and attached to carbon atoms which have at least one fluorine atom attached thereto.

3. A process as claimed in claim 2, wherein said membrane comprises a film of perfluorinated sulfonate polymer.

4. A process as claimed in claim 3, further comprising the step of maintaining said alkaline earth metal halide solution at a pH of about 2.0 to about 4.0.

5. A process as claimed in claim 4, further comprising the step of maintaining said alkaline earth metal halide solution at a temperature of from about 70° C. to about 90° C.

6. A process as claimed in claim 3, wherein the source of water to the cathode compartment after startup being that transported through said membrane or added at a steady rate from an external source.

7. A process as claimed in claim 4, wherein said aqueous alkaline earth metal halide solution is barium chloride solution.

8. A process as claimed in claim 7, wherein barium hydroxide solution or water are initially added to the cathode compartment of the electrolytic cell.

9. A process as claimed in claim 4, wherein said aqueous alkaline earth metal halide solution is strontium chloride solution.

10. A process as claimed in claim 9, wherein strontium hydroxide solution or water is initially added to the cathode compartment of the electrolytic cell.

11. A process as claimed in claim 4, wherein said membrane further comprises a polytetrafluoroethylene cloth mesh reinforcement.

12. A process for the continuous production of alkaline earth metal hydroxide comprising:

a. continuously providing an aqueous alkaline earth metal halide solution to the anode compartment of an electrolytic cell in which an anode and a cathode are maintained in separate anode and cathode compartments, respectively, by a hydrated, cation selective, hydraulically impermeable, ionically conductive membrane interposed between said anode and said cathode;

b. electrolyzing the alkaline earth metal halide solution;

c. continuously removing alkaline earth metal hydroxide solution and hydrogen from the cathode compartment and halogen from the anode compartment;

said membrane comprising first and second layers of a fluorinated polymer with pendant side chains containing sulfonyl groups present as predominant ion exchange sites and attached to carbon atoms which have at least one fluorine atom attached thereto;

said first layer of the polymer having an equivalent weight greater than said second layer; and said membrane being positioned so that said first layer of the polymer faces said cathode compartment.

13. A process as claimed in claim 12, wherein said polymer is a perfluorinated sulfonate polymer.

14. A process as claimed in claim 13, further comprising the step of maintaining said alkaline earth metal halide solution at a pH of about 2.0 to about 4.0.

15. A process as claimed in claim 14, further comprising the step of maintaining said alkaline earth metal halide solution at a temperature of from about 70° C. to about 90° C.

16. A process as claimed in claim 13, wherein the source of water to the cathode compartment after startup being that transported through said membrane or added at a steady rate from an external source.

17. A process as claimed in claim 14, wherein said aqueous alkaline earth metal halide solution is barium chloride solution.

18. A process as claimed in claim 17, wherein barium hydroxide solution or water are initially added to the cathode compartment of the electrolytic cell.

19. A process as claimed in claim 14, wherein said aqueous alkaline earth metal halide solution is strontium chloride solution.

20. A process as claimed in claim 19, wherein strontium hydroxide solution or water are initially added to the cathode compartment of the electrolytic cell.

21. A process as claimed in claim 14, wherein said membrane further comprises a polytetrafluoroethylene cloth mesh reinforcement within said second layer of polymer.

22. A process as claimed in claim 21, wherein said first layer has an equivalent weight of about 1500.

23. A process as claimed in claim 13, wherein said first layer of the polymer has an equivalent weight about 400 greater than said second layer.

24. A process for the continuous production of barium hydroxide comprising:

a. continuously providing an aqueous barium halide solution to the anode compartment of an electrolytic cell in which an anode and a cathode are maintained in separate anode and cathode compartments, respectively, by a hydrated, cation selective, hydraulically impermeable, ionically conductive membrane interposed between said anode and said cathode;

b. electrolyzing the barium halide solution;

c. continuously removing barium hydroxide solution and hydrogen from the cathode compartment and halogen from the anode compartment;

said membrane comprising a cation exchange membrane wherein sulfonyl groups serve as the predominant ion exchange site.

25. The process of claim 24, wherein said membrane comprises a film of a fluorinated polymer with pendant side chains containing sulfonyl groups, said sulfonyl groups present as ion exchange sites and attached to carbon atoms which have at least one fluorine atom attached thereto.

26. The process of claim 24, wherein said membrane comprises a film of perfluorinated sulfonate polymer.

27. The process of claim 24, further comprising the step of maintaining said barium halide solution at a pH of about 2.0 to about 4.0.

28. The process of claim 24, further comprising the step of maintaining said barium halide solution at a temperature of about 70° C. to about 90° C.

29. The process of claim 24, wherein said membrane comprises first and second layers of a fluorinated polymer with pendant side chains containing sulfonyl groups present as predominant ion exchange sites and attached to carbon atoms which have at least one fluorine atom attached thereto;

said first layer of the polymer having an equivalent weight greater than said second layer; and said membrane being positioned so that said first layer of the polymer faces said cathode compartment.

30. The process of claim 29, wherein said membrane further comprises a polytetrafluoroethylene cloth mesh reinforcement within said second layer of polymer.

31. The process of claim 30, wherein said first layer of polymer has an equivalent weight about 400 greater than said second layer of the polymer.

32. The process of claim 30, wherein said first layer of polymer has an equivalent weight of about 1500.

33. A process for the continuous production of an alkaline earth metal hydroxide comprising:

providing an electrolytic cell having an anode compartment and a cathode compartment separated by a cation exchange membrane interposed therebetween, said cation exchange membrane having pendent sulfonyl side chains and being substantially free of side chains that are reactive with the alkaline earth metal to form water insoluble complexes;

providing a stream of alkaline earth metal halide solution to the anode compartment of the electrolytic cell;

electrolyzing the alkaline earth metal halide solution under conditions wherein said membrane is not adversely affected by deposition of water insoluble complexes;

continuously removing a stream of alkaline earth metal hydroxide solution and hydrogen from the cathode compartment and halogen from the anode compartment.

34. The process of claim 33, wherein said cation exchange membrane includes a first layer and a second layer, said first layer having an equivalent weight greater than said second layer; and wherein said membrane is positioned so that said first layer faces said cathode compartment.

35. The process of claim 34, wherein said first layer has an equivalent weight about 400 greater than said second layer.

36. The process of claim 33, wherein said first layer has an equivalent weight of about 1500.

* * * * *